US005782734A

United States Patent [19]

Reuteler

[11] Patent Number: 5,782,734

[45] Date of Patent: Jul. 21, 1998

[54] CARTON FEED OPENING WHEEL ASSEMBLY

[75] Inventor: Urs Reuteler, Kennesaw, Ga.

[73] Assignee: Riverwood International Corporation, Atlanta, Ga.

[21] Appl. No.: 660,801

[22] Filed: Jun. 7, 1996

[51] Int. Cl.[6] ..... B31B 1/80

[52] U.S. Cl. ..... 493/313; 493/123; 493/315

[58] Field of Search ..... 493/309, 312, 493/313, 315, 316, 317, 318, 319, 123–125

[56] References Cited

U.S. PATENT DOCUMENTS

| | | | |
|---|---|---|---|
| 2,612,823 | 10/1952 | Woelfer | 493/317 |
| 3,293,998 | 12/1966 | Farnow | 93/53 |
| 3,956,976 | 5/1976 | Vogel et al. | 493/315 |

*Primary Examiner*—Joseph J. Hail, III
*Assistant Examiner*—Anthony Ojini
*Attorney, Agent, or Firm*—Isaf, Vaughan & Kerr

[57] ABSTRACT

A carton feed opening wheel assembly for opening carton blanks into preformed cartons on a packaging machine is disclosed. The carton feed opening wheel assembly has a pair of spaced and generally parallel endless vacuum conveyor belts moving along a path of travel from a carton magazine assembly to a carton transport conveyor, and a carton opening wheel positioned on the packaging machine with respect to the vacuum conveyor belts for engaging the top portion of an unopened carton blank being moved on the vacuum conveyor belts toward the carton transport conveyor. The carton opening wheel has at least one suction cup supported thereon for engaging the top portion of the carton blank at a speed and direction substantially the same as the speed and direction of the unopened carton blank moving on the vacuum conveyor belts. Thereafter, the speed of the suction cup in the direction of the path of travel is retarded with respect to the speed of the bottom portion of the carton blank being moved on the vacuum conveyor belt as the suction cup is simultaneously moved perpendicularly away from the vacuum conveyor belts so that the carton blank is opened, whereupon the opened carton is then passed to the carton transport conveyor.

15 Claims, 10 Drawing Sheets

CARTON FEED OPENING WHEEL ASSEMBLY

FIELD OF THE INVENTION

This invention relates in general to packaging machines and to methods of packaging articles into containers. More particularly, this invention relates to a method and apparatus for opening carton blanks for forming an open ended carton to receive work products passed therein as the articles and the carton move along a path of travel on the packaging machine.

BACKGROUND OF THE INVENTION

Continuous motion packaging machines are known in the art. Continuous motion packaging machines, to include end loading machines, typically group a selected number of articles, for example, beverage containers, into a desired configuration. When packaging beverages, for example, the articles are grouped into a predetermined configuration or pattern, and either moved singularly or as a group into at least one open end of a preformed "sleeve-type" carton being moved along a path of travel defined on the packaging machine.

Accordingly, continuous motion packaging machines are provided with a supply of unopened carton blanks for being opened into the cartons for receiving articles. These unopened carton blanks are typically stationed at a carton magazine assembly positioned upstream along the path of travel with respect to a carton transport conveyor, as well as upstream of a selector belt assembly, or the equivalent thereof, provided for selecting and/or grouping the articles into a predetermined configuration or pattern for being directed and placed within the product cartons.

The unopened carton blanks are passed from the carton magazine to a carton opening station, at which point the carton blanks are opened into preformed cartons in which either one, or both ends are left open for receiving articles therein. Thereafter, the opened cartons are passed to the carton transport conveyor, and moved along the path of travel adjacent the selector belt and filled with the articles selected for placement therein. Thereafter, and in known fashion, the filled cartons are passed to a glue station where the flaps at the open ends of the cartons are glued and sealed on one another, the cartons then being passed from the packaging machine for further processing and/or shipment.

A number of machines constructed for opening carton blanks into preformed sleeve-type cartons exist. One example of a carton opening machine is disclosed in U.S. Pat. No. 5,415,615 to Culpepper, issued May 16, 1995. Culpepper discloses a hopper supplied with unopened carton blanks, a carton extraction wheel for removing the carton blanks from the hopper and passing the carton blanks to an intermediary wheel, the intermediary wheel in turn passing the carton blanks to a delivery wheel, and a conveyor. The extraction wheel, intermediary wheel, and delivery wheel are each provided with a spaced series of suction cups for passing the carton blanks along the machine, the carton blank being opened as it is held on the suction cups of the intermediary wheel and the counter-rotating delivery wheel, whereupon the delivery wheel drops the open carton onto the conveyor. The device of Culpepper requires the synchronized movement of three separate product handling wheels, each of which may potentially damage the unopened carton blanks, or become jammed by the unopened carton blanks during the carton handling and opening process. Moreover, it does not appear that the device of Culpepper can be readily used with varying sizes of carton blanks, and likely is article/carton size specific.

Another example of a carton opening machine is disclosed in U.S. Pat. No. 4,596,544 to Hull issued Jun. 24, 1986. Hull discloses a vacuum belt carton erector having a storage hopper supplied with unopened carton blanks, and two endless forwardly flaring vacuum belts which hold the sides of the carton blanks and move them simultaneously along the conveyor to partially open the cartons, whereupon the cartons are passed to a cooperating overhead chain structure and an underlying cam wheel for being further opened. As with the device of Culpepper the device of Hull requires extensive product handling which can damage the carton blanks, and/or become jammed by the carton blanks during the opening process, and does not appear to offer the degree of flexibility demanded in packaging operations.

Yet another machine for opening sleeve-type cartons is disclosed in U.S. Pat. No. 5,019,029 to Calvert issued May 28, 1991, in which the machine has a carton pick up device for sequentially engaging and withdrawing collapsed cartons from a hopper, the carton pick up device being supported on an elongated support rod and being so arranged on the support rod that one end thereof extends through an aperture defined in one of the carton panels and into engagement with the other face of the carton panel so as to initiate opening of the carton in coordination with the sliding movement of the carton pick up device relative to the elongated support rod. Once again, a relatively complicated mechanical device is used to open carton blanks, a portion of the device being passed through an opening in a the carton blank for engaging the other wall of the carton blank, all of which may possibly damage the carton blank if the device and the carton blanks are not precisely timed and aligned with respect to one another.

Additional examples of sleeve-type carton opening machines are disclosed in U.S. Pat. Nos. 5,105,931 to Lashyro; 5,104,369 to Calvert; 5,102,385 to Calvert; 3,728,945 to Vuilleumier; and 3,293,998 to Farnow.

Thus, the known carton opening machines require an elaborate mechanical system of timing wheels, mechanical arms, or mechanical rods to physically handle the carton blanks in order to open the carton blanks into preformed open ended sleeve-type cartons used in high speed packaging operations. Moreover, when the high speed at which these operations occur is taken into account, the likelihood of damaging the carton blanks during the opening process illustrates the drawbacks of these inventions and highlights the need for a flexible yet simple carton opening method and apparatus for increased efficiency in opening carton blanks on high speed packaging machines.

What is needed, therefore, but seemingly unavailable in the art is a method and apparatus for opening sleeve-type cartons which also provides the flexibility to open sleeve-type cartons of various shapes and sizes needed during high speed, high volume packaging operations in which not only may the sizes of the predetermined groups of articles be varied, but the sizes of the articles themselves may also be varied. Moreover, what is needed, but unavailable in the art, is a method and apparatus for opening sleeve-type cartons which provides a simple yet reliable method and structure of opening carton blanks in high speed packaging operations with minimal handling of the carton blanks during the opening process to minimize the prospects of damaging or destroying the carton blanks, or stopping packaging machine operations in order to remove damaged carton blanks from the production line.

SUMMARY OF THE INVENTION

The present invention provides an improved carton feed opening wheel assembly which overcomes some of the design deficiencies of other carton opening assemblies known in the art. The carton feed opening wheel assembly of this invention provides a highly flexible method and apparatus of opening sleeve-type carton blanks into preformed cartons which can be matched to the production needs of the packaging machine, and/or packaging operations with which the method and apparatus are used. This invention provides a much greater degree of flexibility then heretofore known in the art by minimizing the physical handling of the carton blanks during the opening process, yet providing a simple and efficient device that it is readily adapted for use in both high speed and low speed packaging operations, is well suited for use with virtually any type of carton blank and/or paperboard carrier to be opened, and does so quickly and simply without the need for sophisticated machinery or other devices adapted for handling and opening carton blanks into preformed cartons.

The invention disclosed herein attains this high degree of flexibility while maintaining simplicity in design and operation by teaching a method of opening carton blanks in which a carton opening wheel assembly is positioned at a carton opening station supported on a packaging machine with respect to an endless vacuum conveyor belt adapted to receive unopened carton blanks from an upstream carton magazine assembly, and for passing the carton blanks as they are being formed into opened cartons to a downstream carton transport conveyor.

Accordingly, the novel and improved method of the this invention includes the steps of moving at least one suction cup supported on the carton opening wheel assembly in the direction of the path of travel along the vacuum conveyor belt and into engagement with the top portion of an unopened carton blank at substantially the same speed and direction as the speed and direction of the carton blank on the conveyor belt. Thereafter, the speed of the suction cup in the direction of the path of travel is retarded with respect to the speed of the vacuum conveyor belt holding the bottom portion of the unopened carton blank thereon, while moving the suction cup in a generally perpendicular direction upward and away from the vacuum conveyor belt for lifting the top portion of the carton blank with respect to the bottom portion of the carton blank and thus opening the carton blank as it moves in uninterrupted fashion along the path of travel toward and onto the carton transport conveyor. This method, therefore, is suited to most any type of continuous motion packaging machine, whether the machine is run at high speed, low speed, or any range of speeds therebetween, and for handling virtually any type of unopened carton blank to be opened into a sleeve-type carton.

The novel carton feed opening wheel assembly of this invention which practices this method of opening sleeve-type carton blanks is thus well suited for use on continuous motion packaging machines. The packaging machine will have an infeed end and a spaced discharge end, and a carton transport conveyor supported on the packaging machine and extending along a path of travel from the infeed end toward the discharge end of the machine. A carton magazine assembly is supported at the infeed end of the packaging machine and has a supply of unopened cartons blanks thereon, each unopened carton blank having a bottom portion and juxtaposed top portion, and a carton opening station supported on the packaging machine intermediate the carton magazine assembly and the carton transport conveyor.

The carton feed opening wheel assembly includes one endless vacuum conveyor belt positioned at the carton opening station and extending along the path of travel from the carton magazine assembly to the carton transport conveyor, the vacuum conveyor belt being supplied with unopened carton blanks placed thereon from the carton magazine assembly. A vacuum force is applied to the bottom portion of the unopened carton blanks received on the vacuum conveyor belt which holds the carton blanks thereon as they are moved in series toward the carton transport conveyor. A carton opening wheel is positioned at the carton opening station above and with respect to the vacuum conveyor belt, the carton opening wheel having a wheel frame constructed about a central longitudinal shaft and at least one pair of parallel spaced arms extending radially away therefrom, the pair of arms supporting at least one suction cup constructed and arranged for engaging the top portion of the unopened carton blanks.

The carton feed opening wheel assembly of this invention also includes a drive motor for rotating the wheel frame about the central shaft so that the suction cup engages the top portions of the unopened carton blanks at substantially the same speed and direction as the speed and direction of the carton blanks moving on the vacuum conveyor belt. The drive motor is constructed and arranged to thereafter retard the speed of the suction cup in the direction of the path of travel with respect to the speed of the vacuum conveyor belt, while simultaneously moving the suction cup in a generally perpendicular direction away from the vacuum conveyor belt for lifting the top portion of the carton blank with respect to the bottom portion to open the carton.

The vacuum conveyor belt of this invention includes an elongated conveyor belt housing supporting the conveyor belt thereon, a series a closely spaced openings defined in the surface of the vacuum conveyor belt in communication with a vacuum chamber defined within the conveyor belt housing and extending along at least a portion of the length of the conveyor belt housing, and a vacuum pump for drawing air through the openings in the surface of the vacuum belt into the vacuum chamber and therefrom to create a suction force for holding the bottom portion of the unopened carton blanks on the endless conveyor belt. The same suction pump, or if preferred a second suction pump, can be used for providing a suction force for the suction cup or cups supported by the arms of the carton opening wheel to hold the top portion of the unopened carton blank as it is being pulled upward and away from the bottom portion to open the carton blank.

In a preferred embodiment of this invention, the carton opening wheel includes three pairs of equally spaced arms extending radially away from a central longitudinal shaft, each pair of arms supporting a connecting shaft with at least one suction cup thereon, the carton opening wheel being constructed and arranged to maintain a constant orientation of the suction cup or cups with respect to the surface of the vacuum conveyor belt, and thus a constant orientation with respect to the top portion of each unopened carton blank received on the vacuum conveyor belt from the carton magazine supply. This is accomplished by providing a phasing hub on the central longitudinal shaft and a phasing pulley separately mounted on one of the ends of each connecting shaft, the phasing pulleys being in substantial alignment with the phasing hub. Separate phasing belts are received on each pulley as well as on the hub, and thus each connecting shaft and the suction cups thereon are rotated about the longitudinal axes of the connecting shafts, respectively, as the carton opening wheel frame rotates about its central longitudinal axis to maintain the constant orientation of the suction cups with respect to the surface of the vacuum conveyor belt.

The carton feed opening wheel assembly also includes a drive motor and a control processor in which an electronic cam profile, or series of cam profiles, is stored for operating the drive motor to retard its speed, and thus the speed of the suction cup in the direction of the path of travel with respect to the vacuum conveyor belt for opening the carton blanks. If so desired, a separate electronic cam profile can be stored within the control processor for each of a number of predetermined carton blank sizes and/or packaging configurations.

The cooperation of the structural elements of this invention, as well as the method practiced by this invention results in a carton feed opening wheel assembly of great flexibility, which allows a single carton feed opening wheel assembly to be used on a packaging machine for handling a variety of packaging needs and carton sizes, as well as providing a simple method and structure for matching the speed of the carton feed opening wheel assembly to the speed of packaging operations being conducted on the packaging machine by having a minimal number of mechanical parts which require adjustment or maintenance during operation. Accordingly, the objects of the present invention include the ability to readily open any number of carton blank sizes and shapes without changing the mechanical structure of the carton feed opening wheel assembly, as well as providing a carton feed opening wheel assembly which can be used with any variety of article configurations or carton types and dimensions. This invention accomplishes these objects while providing for efficient, continuous, and high speed packaging of articles.

DETAILED DESCRIPTION OF THE PREFERRED EMBODIMENT

Figure 1:
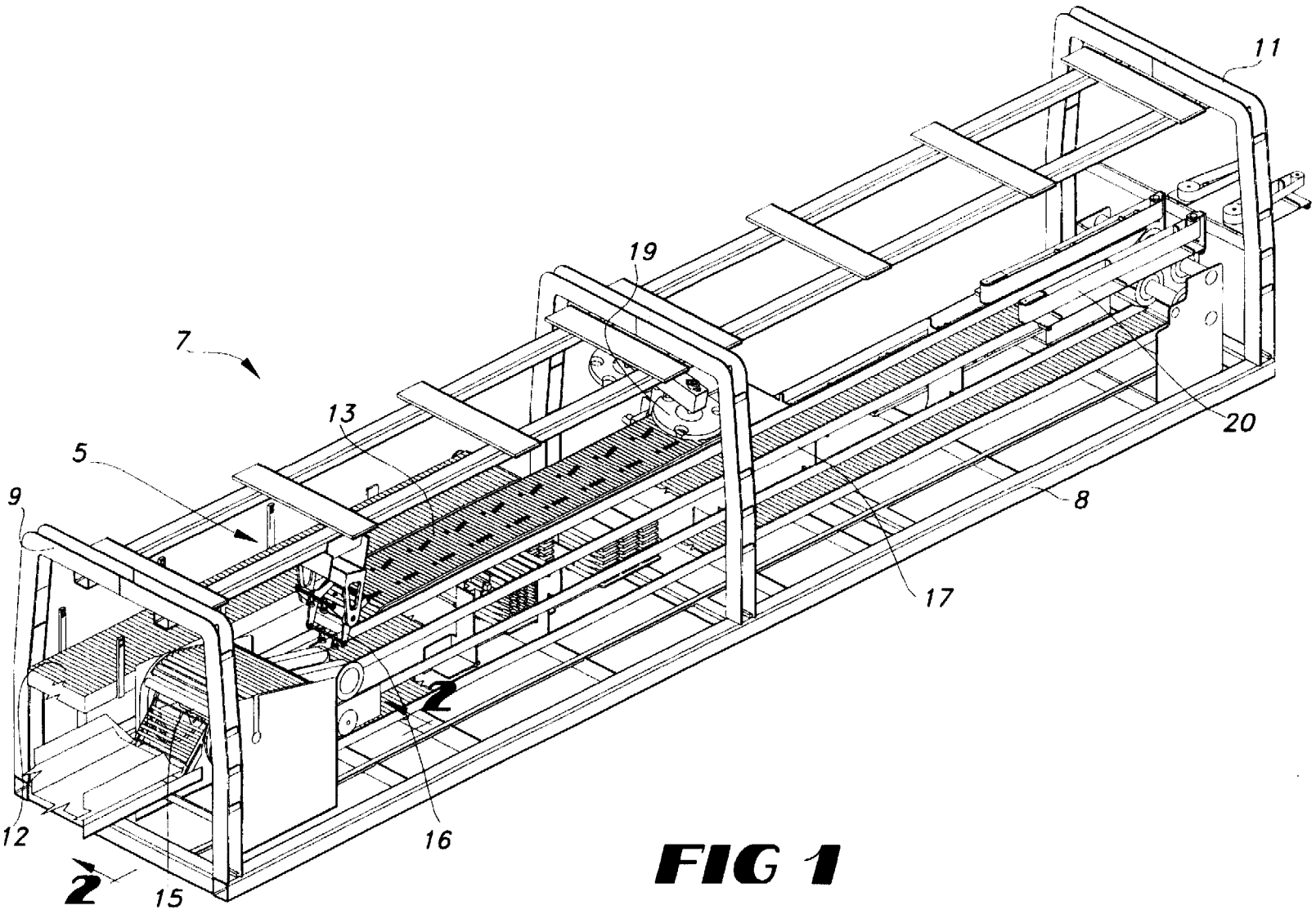
FIG. 1 is a perspective view of a packaging machine having a preferred embodiment of the carton feed opening wheel assembly positioned thereon.

Referring now to the drawings, in which like reference characters indicate like parts throughout the several views, numeral 5 of FIG. 1 illustrates a preferred embodiment of the carton feed opening wheel assembly of this invention positioned on a packaging machine 7. Packaging machine 7 has a walk-in type framework 8 extending along its length, with an infeed end 9 and a spaced discharge end 11. Supported on framework 8 is an infeed conveyor 12 for supplying a randomly ordered series of articles (not illustrated) to a selector belt assembly 13. Selector belt assembly 13, in the fashion described in U.S. Pat. No. 5,546,734, issued on Aug. 20, 1996 Trademark Office on Sep. 2, 1993, and incorporated herein by reference, describes the structure of selector belt assembly 13, as well as the manner in which the selector belt assembly orders the articles into predetermined group sizes and moves the groups of articles along the selector belt assembly for being packaged.

Also supported on framework 8 of packaging machine 7 is a carton magazine assembly 15 supplied with a series of unopened carton blanks 22 (FIG. 2) to be opened into the preformed sleeve-type cartons used for receiving the articles to be packaged. Positioned along a path of travel extending from the infeed end toward the discharge end of the packaging machine is a carton opening station 16, at which carton feed opening wheel assembly 5 is positioned. Positioned downstream of the carton opening station is an endless and elongated carton transport conveyor 17 constructed and arranged to receive the opened cartons from the carton feed opening wheel assembly, and to move the open cartons adjacent, and along at least a portion of the length of, selector belt assembly 13 for receiving the ordered groups of articles therein. The filled cartons are then moved along the carton transport conveyor downstream past dual pocket loader wheel assembly 19 which seats the articles within the carton, the carton then being moved along the carton transport conveyor to a glue application station (not illustrated) at which point the open flaps of the carton are glued and sealed on one another prior to passing the carton through compression and discharge section 20 formed at the discharge end 11 of packaging machine 7. As shown in FIG. 1, packaging machine 7 may include the QUICKFLEX family of packaging machines manufactured by Riverwood International Corporation of Atlanta, Ga.

Figure 2:
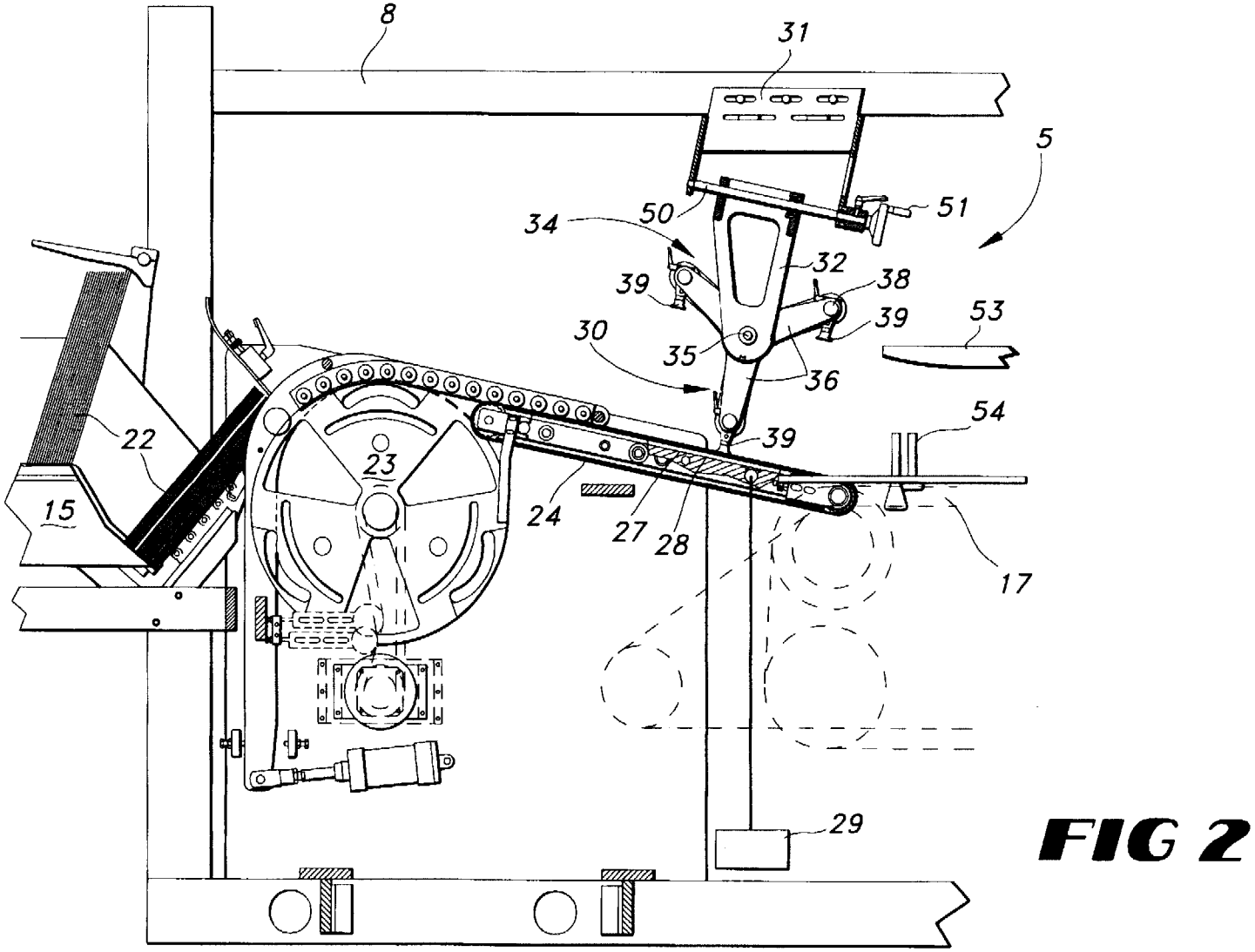
FIG. 2 is a side elevational view along line 2—2 of FIG. 1.
Figure 3:
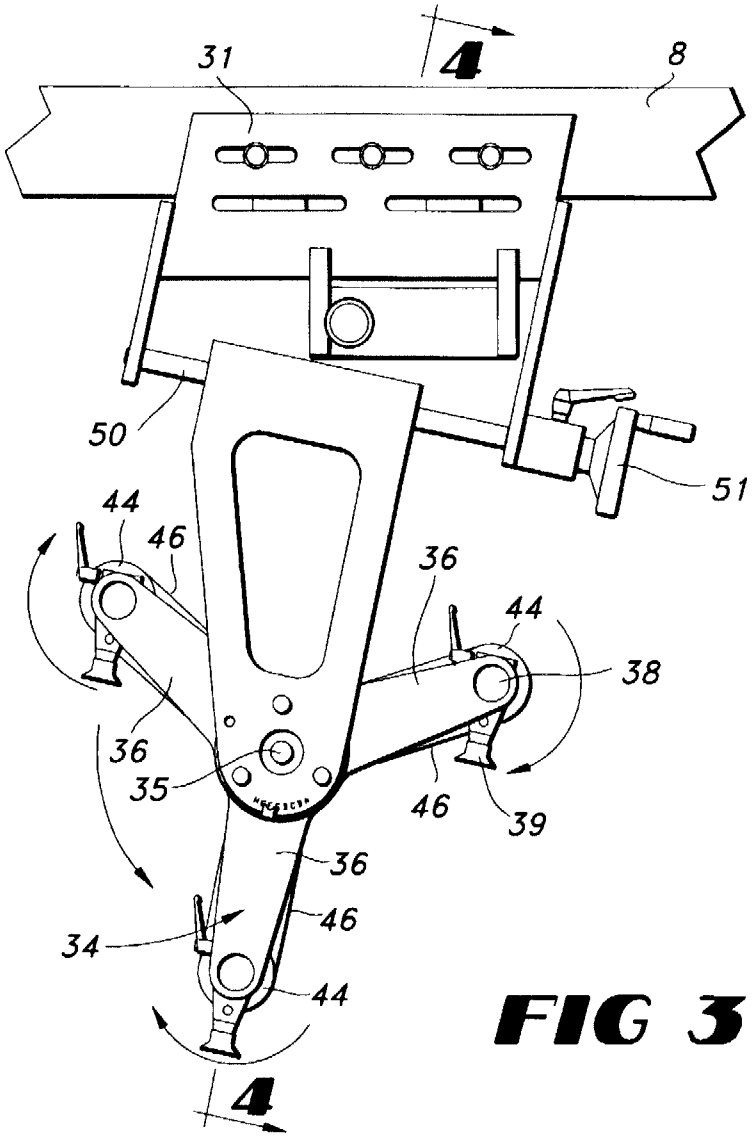
FIG. 3 is an enlarged side elevational view of the carton opening wheel of this invention.
Figure 4:
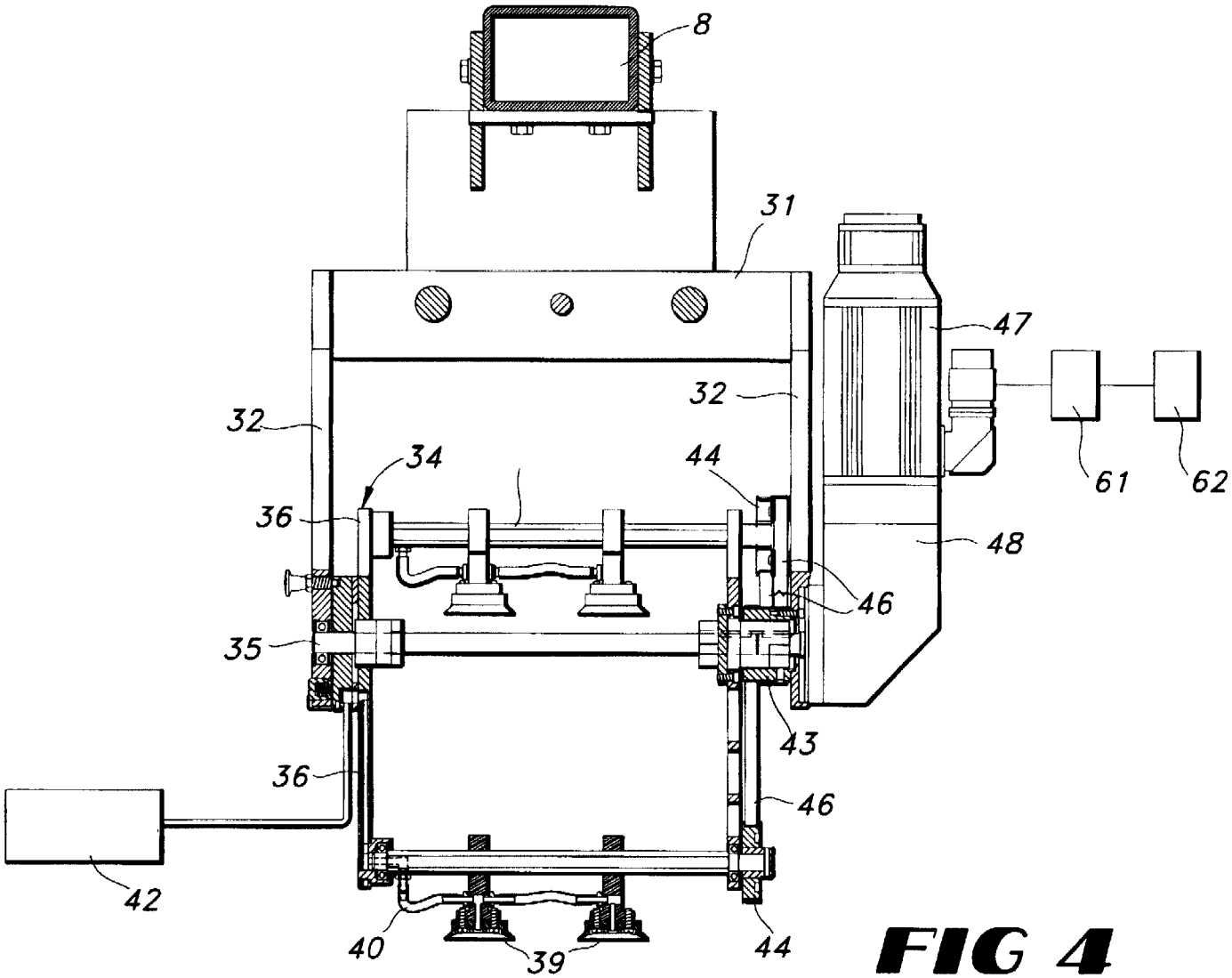
FIG. 4 is an end cross-sectional view along line 4–4 of FIG. 3.

Carton feed opening wheel assembly 5 is illustrated in greater detail in FIGS. 2–4. In FIG. 2, carton feed opening wheel assembly 5 is shown positioned at carton opening station 16 (FIG. 1) intermediate carton magazine assembly 15 and carton transport conveyor 17. Individual unopened carton blanks 22 are passed in series by picker wheel assembly 23 onto a vacuum conveyor belt 24. Picker wheel assembly 25 is more fully disclosed in application Ser. No. 08/367,459 entitled Carton Feeder Assembly, filed in the U.S. Patent & Trademark Office on Dec. 30, 1994, and incorporated herein by reference.

Vacuum conveyor belt 24 has a closely spaced series of openings 26 defined therein and extending therethrough in communication with a vacuum chamber 27 formed in elongated conveyor belt housing 27, vacuum conveyor belt 24 being generally sealed on conveyor belt housing 28. Conveyor belt housing 28 is constructed as a substantially U-shaped and elongated channel sealed at its ends, vacuum chamber 27 extending along at least a portion of the length of conveyor belt housing 28, and preferably extending along predominately all of the length of the conveyor belt housing. A vacuum pump 29, illustrated schematically in FIG. 2, is in sealed fluid communication with vacuum chamber 27 thus creating a vacuum to draw air through openings 26 defined in conveyor belt 24, and a vacuum force for holding the bottom portion 58 (FIG. 5) of unopened carton blank 22 on the vacuum conveyor belt as it moves along the path of travel from the carton magazine assembly toward the carton transport conveyor. Although a single vacuum conveyor belt 24 is shown in FIG. 2, it is anticipated that an identical vacuum conveyor belt 24 will be spaced therefrom, and will extend parallel to vacuum conveyor belt 24 along the path of travel as illustrated generally in FIG. 1. Both vacuum conveyor belts 24 are constructed identically, as described above.

Still referring to FIG. 2, and as shown in greater detail in FIGS. 3 and 4, carton feed opening wheel assembly 5 includes a carton opening wheel 30 positioned above, and with respect to, vacuum conveyor belts 24. Carton opening wheel 30 is supported on frame 8 of packaging machine 7 by support frame 31. A pair of spaced and generally parallel support arms 32 (FIG. 4) extend downwardly from support frame 31 for supporting wheel frame 34 thereon. Wheel frame 34 includes a central longitudinal shaft 35 positioned transversely with respect to the length of vacuum conveyor belts 24. Three pairs of arms 36 extend radially from longitudinal shaft 35, each pair of arms being spaced equally and radially from one another about central longitudinal shaft 35. Each arm within each pair of arms is spaced apart from, and generally parallel to the other, as best shown in FIG. 4.

Referring now to FIG. 4, a connecting shaft 38 is fitted to each pair of arms 36, and is supported thereon for rotation about its longitudinal axis. A pair of generally parallel suction cups 39, spaced from one another, are supported on each connecting shaft 38. Suction cups 39 are each provided with a vacuum line 40, vacuum line 40 being in communication with a vacuum pump 42. It is anticipated, however, that vacuum pump 29 illustrated in FIG. 2 may also serve as the vacuum source for the vacuum created by suction cups 39, if so desired.

Referring now to FIGS. 3 and 4, central longitudinal shaft 35 is provided with a phasing hub 43 at one of its ends. Three separate phasing pulleys, one on the end of each connecting shaft 38, are provided. The phasing pulleys are offset with respect to one another, but yet each is substantially aligned with phasing hub 43. Three separate and generally parallel phasing belts 46, illustrated in FIGS. 3 and 4, are passed over phasing hub 43 and each of phasing pulleys 44, respectively.

A servomotor 47, illustrated in FIG. 4, is attached to a gear reducer 48, both of which are supported on support frame 31 of the carton feed opening wheel assembly. Servomotor 47 drives central longitudinal shaft 35 about its longitudinal axis and rotates each of connecting shafts 38 in a generally counterclockwise circular path of travel about longitudinal shaft 35 in the direction of the path of travel along packaging machine 7. Although shown moving in counterclockwise direction, it is anticipated that packaging machine 7 can be laid out in opposite hand, so that wheel frame 34 would be rotated in clockwise fashion if so desired.

As wheel frame 34 is rotated in counterclockwise fashion, each of phasing belts 46 received on phasing hub 43 and its respective phasing pulley 44 is moved over the hub and each pulley so that each of connecting shafts 38, and particularly suction cups 39 thereon, maintain a constant orientation with respect to the surface of vacuum conveyor belts 24 to ensure that suction cups 39 are always in a position to be received on top portion 57 of unopened carton blanks 22 (FIGS. 5A–5E). Thus, as wheel frame 34 rotates in counterclockwise fashion, each of connecting shafts 38 is rotated by the phasing hub, phasing belts, and phasing pulleys in clockwise fashion as illustrated in FIG. 3. Phasing hub 43 and phasing pulleys 44 may be smooth surfaced, as shown, or may be toothed to receive a toothed phasing belt 46 thereon if so desired. In addition it is also anticipated that phasing hub 43 could be a chain sprocket, and that phasing pulleys 44 could be chain sprockets also, and that each of phasing belts 46 would be phasing chain as opposed to a belt.

Referring now to FIGS. 2 and 3, support arms 32 and wheel frame 34 are supported for movement along the path of travel with respect to vacuum conveyor belts 24 on a threaded adjustment rod 50 passed through a pair of threaded openings (not illustrated) defined in support frame 31, adjustment rod 50 being operated by hand crank 51 for moving support arms 32, and thus carton opening wheel 30 along the path of travel toward and away from carton magazine assembly 15 and/or carton transport conveyor 17, respectively. This is done in order for properly position the point at which suction cup(s) 39 engage top portion 57 of unopened carton blanks 22 as they are moved along the path of travel on carton feed opening wheel assembly 5. Although a hand crank 51 is shown in FIGS. 2 and 3, it is anticipated that a drive motor, for example a servomotor, could be provided for actuating adjustment rod 50 to move the wheel frame along the path of travel to the desired location.

OPERATION

Figure 5A:
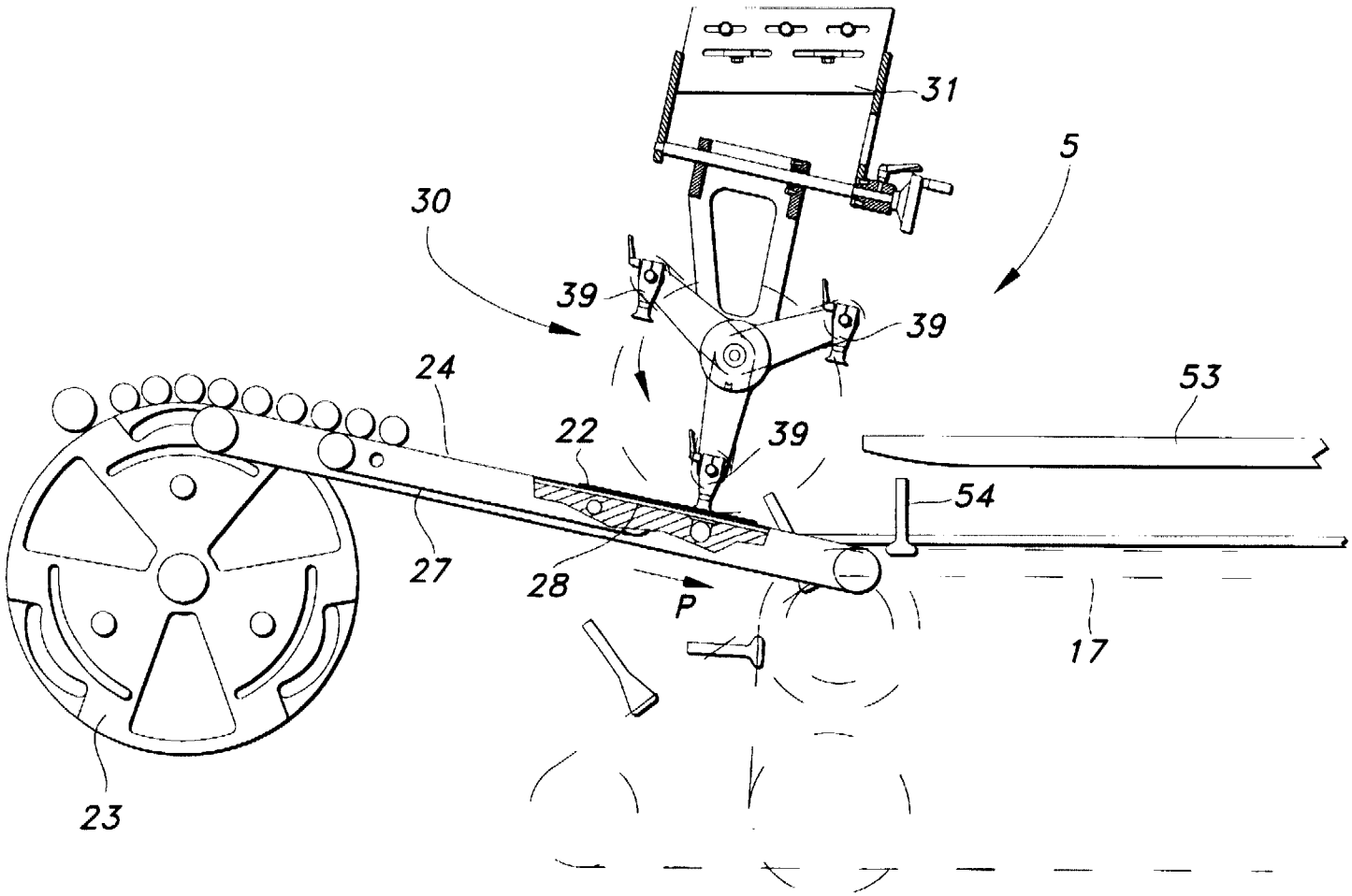
FIGS. 5A–5E are sequential views of the carton feed opening wheel assembly of this invention opening a paperboard carton blank into a preformed sleeve-type carton.
Figure 5B:
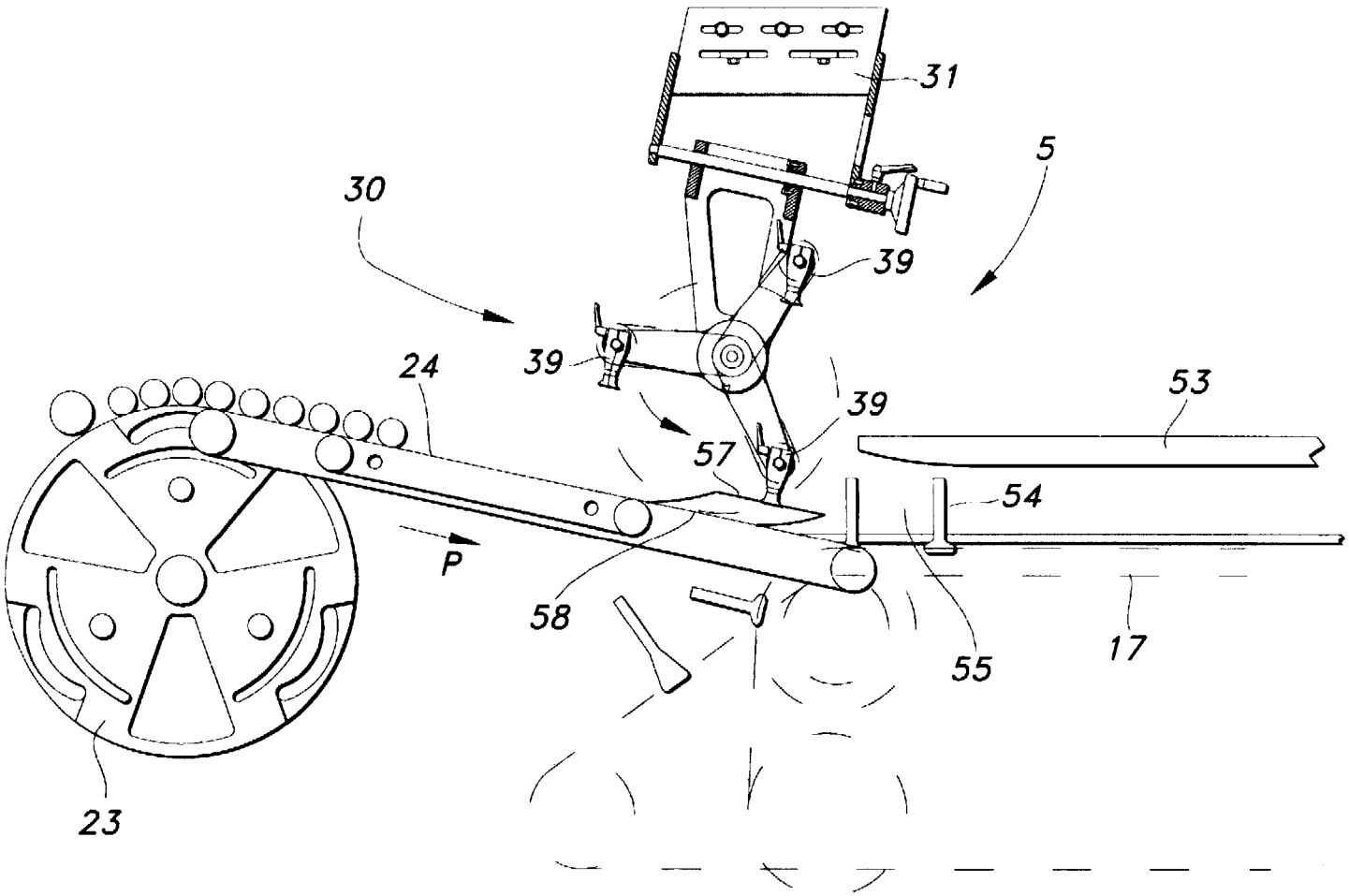

The operation of carton feed opening wheel assembly 5 is illustrated in FIGS. 5A–5E. Turning first to FIG. 5A, an unopened carton blank 22 is being moved on vacuum conveyor belt 24 in the direction of the path of travel from picker wheel assembly 23 toward carton transport conveyor 17. Unopened carton blank 22 has a bottom portion 58 (FIG. 5B) received on vacuum conveyor belts 24, and a juxtaposed top portion 57 (FIG. 5B).

As unopened carton blank 22 is passed onto the surface of vacuum conveyor belt 24, it is received on the spaced openings 26 defined therein and in communication with vacuum chamber 27, so that the bottom portion 58 (FIG. 5B) of the unopened carton blank is held in position on the vacuum conveyor belt and is moved along the path of travel toward carton opening wheel 30. As unopened carton blank 22 approaches the carton opening wheel, shown in FIG. 5A, one of suction cups 39 is moved into engagement with top portion 57 of the unopened carton blank at substantially the same speed and in substantially the same direction as the speed and direction of the unopened carton blank along vacuum conveyor belts 24. The point along the path of travel at which suction cup 39 will engage top portion 57 is based on the size of the carton blank to be opened, and can be adjusted through adjustment rod 50 and crank 51.

As the unopened carton blank continues to move along the path of travel, as shown in FIG. 5B, the rotational speed of carton opening wheel 30 about central longitudinal shaft 35 is slowed by slowing servomotor 47 (FIG. 4) to retard the speed of suction cup 39 in the direction of the path of travel while also lifting suction cup 39, and thus top portion 57 of carton blank 22, away from bottom portion 58 to start opening the carton blank as the bottom portion 58 continues to move along the path of travel on vacuum conveyor belt 24. Simultaneously, lugs 54 of carton transport conveyor 17, forming pockets or flights 55 therebetween, continue to move along their respective chain conveyors, as more fully described in patent application Ser. No. 08/118,111 filed on Sep. 2, 1993, and incorporated herein by reference, for receiving the carton blank to be opened and placed therein.

Figure 5C:
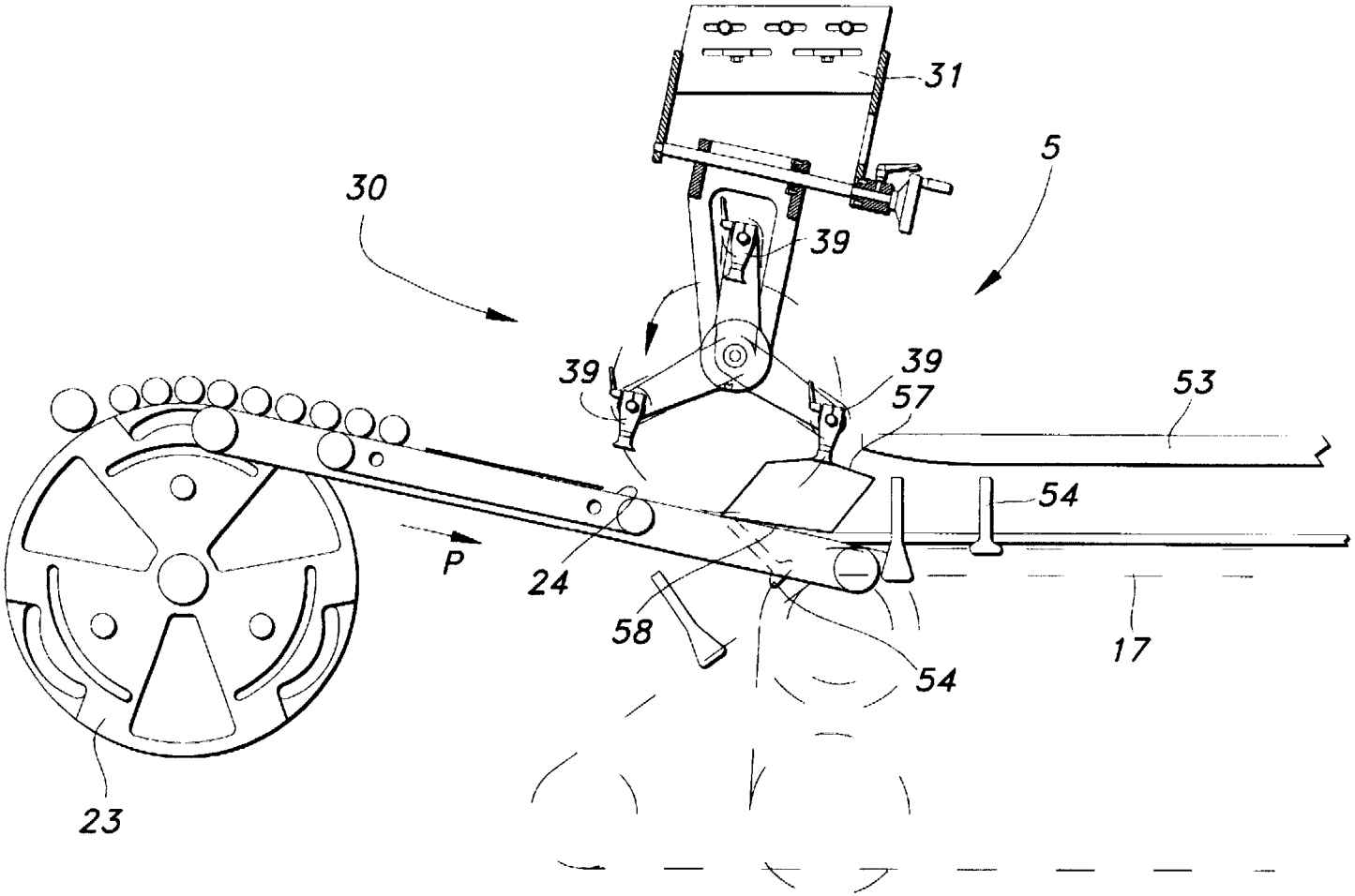

As shown in FIG. 5C, suction cup 39 continues to move upward in counterclockwise direction and in the direction of the path of travel at a velocity less than the velocity of bottom portion 58 on vacuum conveyor belts 24. As bottom portion 58 is being passed onto carton transport conveyor 17 between lugs 54, top portion 57 is being moved toward a pair of spaced upper guide rails 53 provided as a part of the carton transport conveyor as a second unopened carton blank is being passed by picker wheel 23 onto vacuum conveyor belt 24, and the next consecutive suction cup 39 is moved toward engagement with this second unopened carton blank.

Figure 5D:
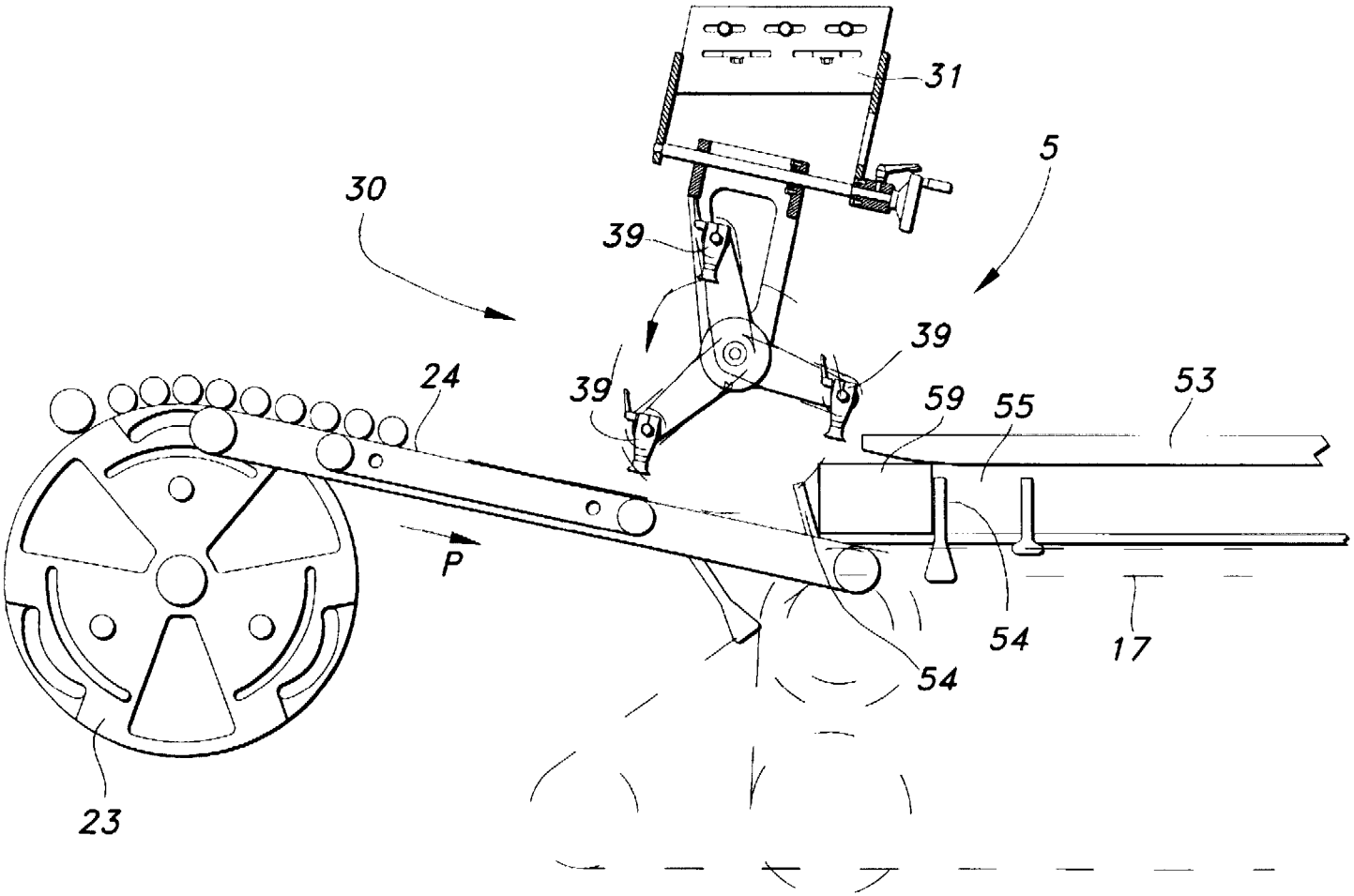

As next shown in FIG. 5D, therefore, top portion 57 has been received against guide rails 53 which act to hold top portion 57 in position with respect to the movement of carton opening wheel 30 and suction cup 39 thereof so that the suction cup releases top portion 57, and trailing lug 54 of carton transport conveyor 17 is moved up against bottom portion 58 of the now open carton 59, the carton being received within pocket 55 of carton transport conveyor 17. Simultaneously, the second unopened carton blank being carried on vacuum conveyor belts 24 is moved closer toward the second suction cup 39 which will be engaged on top portion 57 of the unopened carton blank to open the next carton blank in series and in timed relationship with the movement of carton transport conveyor 17 and the other components of packaging machine 7.

Figure 5E:
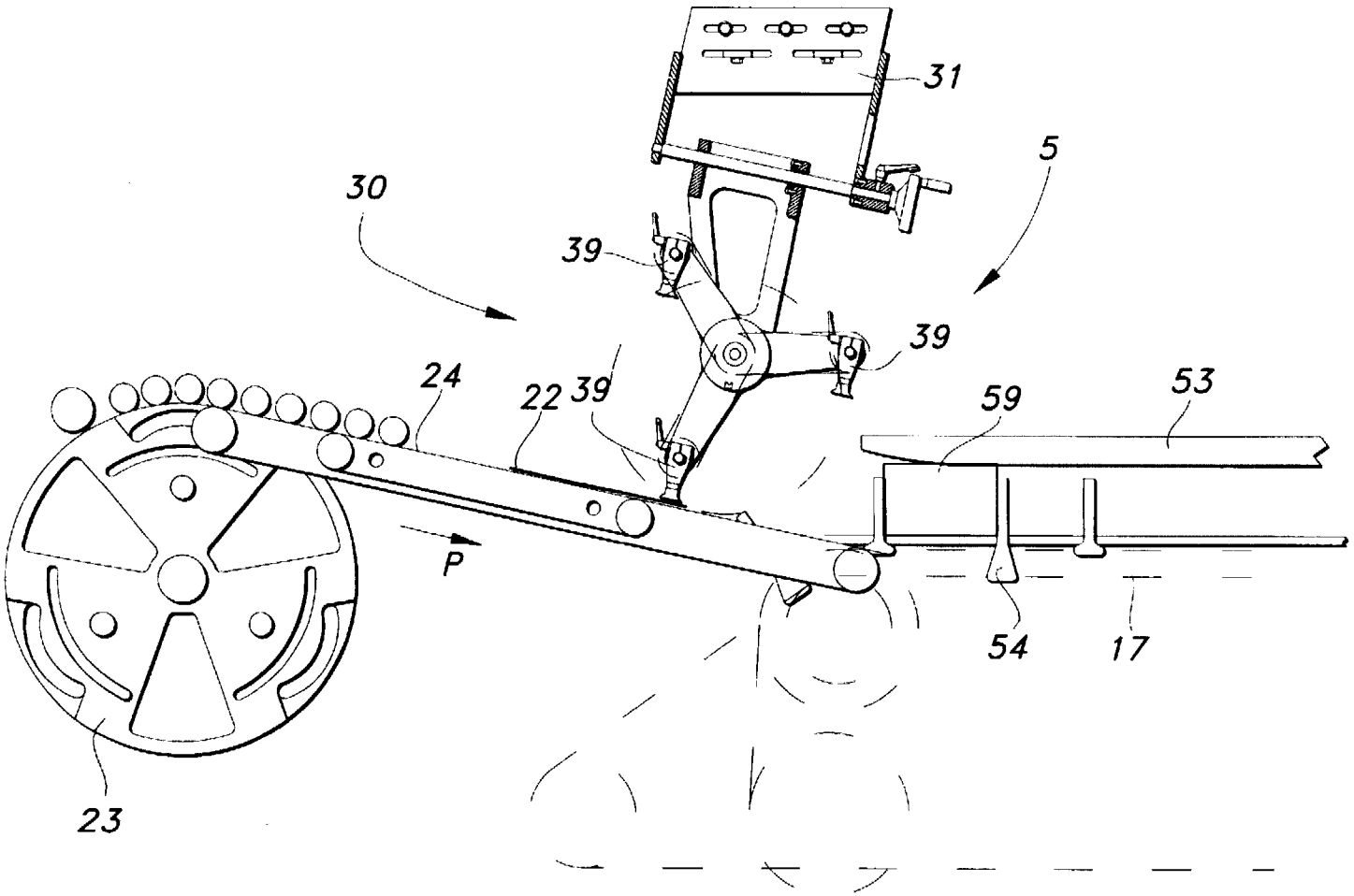

Thus, and as shown in FIG. 5E, opened carton 59 is now received by and being moved on carton transport conveyor 17 as suction cup 39 is now engaging the top portion 57 of the second unopened carton blank 22 being moved along vacuum conveyor belts 24. This process is continuously repeated during the operation of packaging machine 7. When it is desired to package different articles, or different configurations of articles, the supply of unopened carton blanks 22 on carton magazine assembly 15 is changed, carton opening wheel 30 is positioned with adjustment rod 50 with respect to vacuum conveyor belts 24 as needed for the cartons being opened, the appropriate electronic cam profile is used to control servomotor 47, and the process is started once again. Thus, carton feed opening wheel assembly of this invention, provides a quick, simple, and universal method and apparatus for opening carton blanks heretofore unknown in the art.

In conventional fashion, packaging machine 7 will be provided with a control processor 61 (FIG. 4), not illustrated, for automatically controlling the operation of carton feed opening wheel assembly 5, as well as the additional components of the packaging machine. It is anticipated that the control processor will be an IBM PC compatible computer having an internal computer-readable medium with a series of preprogrammed electronic cam data profiles 62 (FIGS. 4, 6) stored therein, as well as the control program operating packaging machine 7, and/or that the control processor will be provided with a device for reading a computer-readable medium, for example, a floppy disk drive or a CD ROM drive, so that it may receive the appropriate preprogrammed data and control programming operations to operate carton feed opening wheel assembly 5 in conjunction with packaging machine 7. Thus, in FIG. 6 three different illustrative electronic cam profiles 62A, 62B, and 62C are shown, each of these cam profiles being stored as preprogrammed data within the control processor and the computer-readable media made available to the control processor.

Figure 6:
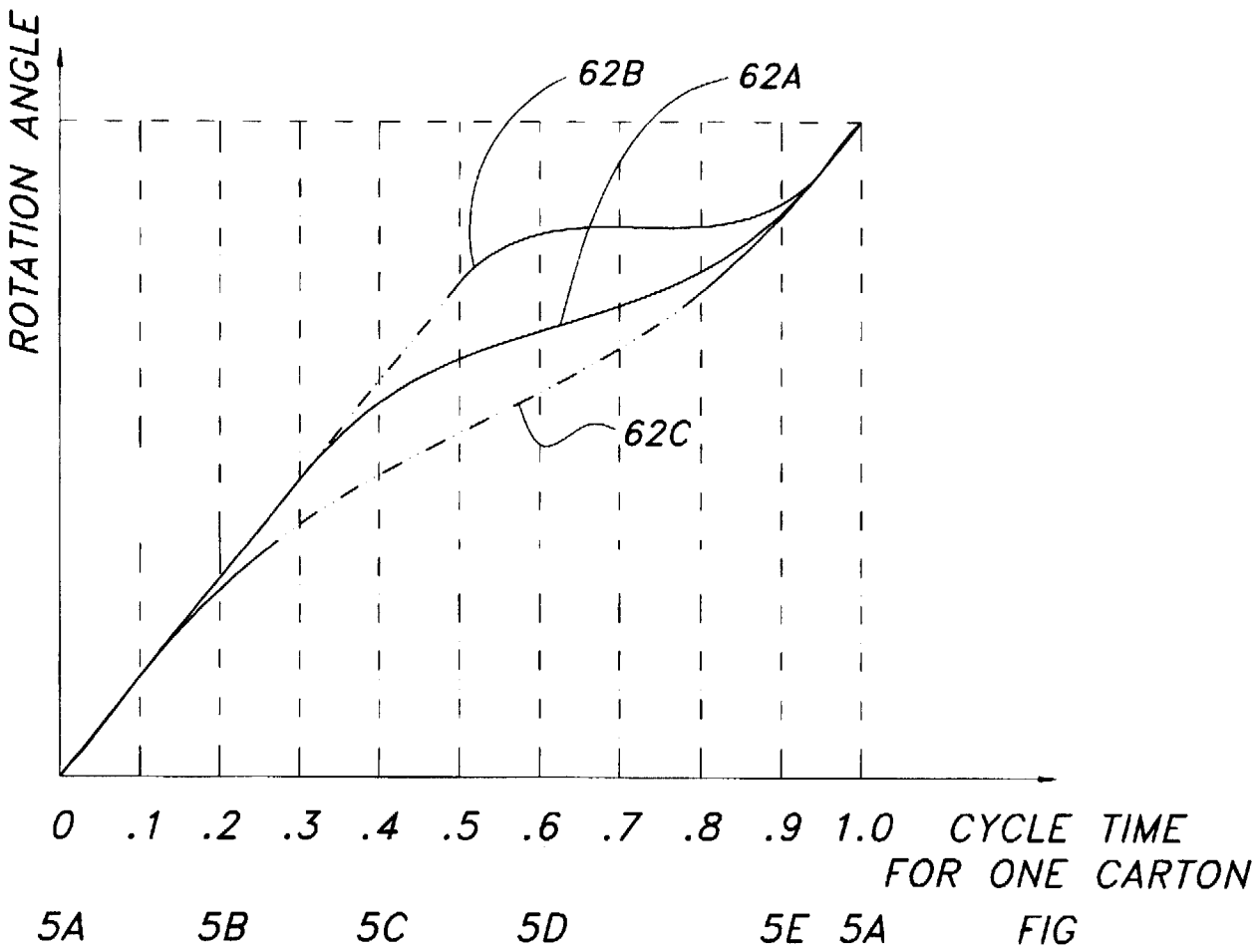
FIG. 6 is an illustration of a series of possible electronic cam profiles used to control the drive motor of this invention.

In FIG. 6 the vertical axis of the graph shows the rotational angle of carton opening wheel 30 during a single carton opening cycle, as shown in FIGS. 5A–5E. The operation of carton feed opening wheel assembly 5 for one carton opening cycle with respect to the rotational angle of carton opening wheel 30 is shown along the bottom horizontal axis of FIG. 6.

The three illustrative cam profiles, denoted by the reference characters 62A, 62B, 62C, serve to show the control methodology used in operating servomotor 47 for rotating wheel frame 34 about central longitudinal shaft 35. Thus, and as shown in line 62A, wheel frame 34 rotates in relatively constant fashion until approximately half of the carton opening cycle is attained, whereupon the rotational angle of wheel frame 34 is slowed, and in fact remains constant between the cycle time notations indicated by 0.6 to 0.8, whereupon the rotational angle of wheel frame 34 resumes. This period of constant rotational movement is equal to a dwell period in which the movement of wheel frame 34, and particularly the movement of suction cup 39, in the direction of the path of travel is retarded with respect to the movement of carton blank 22 on vacuum conveyor belts 24, whereupon top portion 57 is pulled upward and away from bottom portion 58 as bottom portion 58 is held in position on the vacuum conveyor belts by vacuum pump 29 as described in greater detail above. Thus, as the bottom of the carton blank continues to move along the path of travel, and as the top portion of the carton blank is lifted, the sides of the carton blank are extended so that the carton blank forms a substantially and continuous open ended sleeve for receiving a predetermined group of articles therein.

Lines 62B and 62C of FIG. 6 represent the cam profiles for different sized cartons being opened on carton feed opening wheel assembly 5. Thus, the electronic cam profile of lines 62B and 62C shows less of a dwell period than line 62A, so that suction cups 39 of wheel frame 34 continue to move in the direction of the path of travel at a velocity rate greater than that shown in line 62A for opening cartons of sizes different than those illustrated in FIGS. 5A–5E, yet still less than the velocity of vacuum conveyor belts 24.

So designed, constructed, and operated, carton feed opening wheel assembly 5 allows for far greater flexibility in packaging operations, and in particular in opening carton blanks, than previously known in the art, and does so with a mechanism which is far simpler than those known in the art. While a preferred embodiment of the invention has been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements, and the claimed elements, are intended to include any structure, material, or acts for performing the functions in combination with other claimed elements, as specifically claimed herein.

I claim:

1. A carton feed opening wheel assembly for opening carton blanks into cartons on a packaging machine, the packaging machine having a framework with an infeed end and a spaced discharge end, a carton transport conveyor supported on the framework and extending along a path of travel from the infeed end toward the discharge end of the packaging machine, a carton magazine assembly supported at the infeed end of the packaging machine and having a supply of unopened carton blanks, each unopened carton blank having a bottom portion and a juxtaposed top portion, and a carton opening station supported on the framework intermediate the carton magazine assembly and the carton transport conveyor, said carton feed opening wheel assembly comprising:

a) at least one endless vacuum conveyor belt positioned at the carton opening station and extending along the path of travel from the carton magazine assembly to the carton transport conveyor, said at least one vacuum conveyor belt being supplied with unopened carton blanks placed thereon by the carton magazine assembly;

b) means for applying a vacuum to the bottom portion of the unopened carton blanks received on said at least one vacuum conveyor belt to hold the bottom portion of the unopened carton blanks on said vacuum conveyor belt as said at least one conveyor belt moves toward the carton transport conveyor;

c) a carton opening wheel positioned at the carton opening station with respect to said at least one vacuum conveyor belt, said carton opening wheel having a wheel frame constructed about a central longitudinal shaft and at least one pair of parallel spaced arms extending radially away from said central shaft, said at least one pair of arms supporting at least one suction cup constructed and arranged for engaging the top portion of the unopened carton blank;

d) drive means for rotating said wheel frame about said central shaft; and f) a control processor, said control processor having an electronic cam profile programmed therein, said electronic cam profile being programmed to control the speed of said drive means with respect to the speed of said at least one vacuum conveyor belt;

g) wherein said at least one suction cup engages the top portion of the unopened carton blanks being moved on said at least one vacuum conveyor belt in the direction of the path of travel at substantially the same speed and direction as the speed and direction of the carton blanks moving on said at least one vacuum conveyor belt, said control processor signaling said drive means to thereafter retard the speed of said at least one suction cup in the direction of the path of travel with respect to the speed of said vacuum conveyor belt assembly while simultaneously moving said at least one suction cup in a generally perpendicular direction away from said vacuum conveyor belt for lifting the top portion of the carton blank with respect to the bottom portion of the carton blank to open the carton blank.

2. The carton feed opening wheel assembly of claim 1, said at least one vacuum conveyor belt having a series of closely spaced openings defined in the surface thereof and extending therethrough.

3. The carton feed opening wheel assembly of claim 2, said at least one vacuum conveyor belt further comprising:

an elongate conveyor belt housing supporting said at least one vacuum conveyor belt for movement thereon and extending along the length of said at least one vacuum conveyor belt;

a vacuum chamber defined within said conveyor belt housing and extending along at least a portion of the length of the conveyor belt housing, said vacuum chamber being substantially sealed on the bottom of said at least one vacuum conveyor belt and being in communication with said closely spaced openings defined therein; and means for creating a vacuum within said vacuum chamber for drawing air through said openings into said vacuum chamber;

whereby the vacuum created within said vacuum chamber holds the unopened carton blanks on said at least one vacuum conveyor belt as it moves toward the carton transport conveyor.

4. The carton feed opening wheel assembly of claim 1, said carton opening wheel further comprising a support frame mounted on the framework of the packaging machine, said support frame being constructed and arranged to support said carton opening wheel thereon for rotation and to position said carton opening wheel with respect to said at least one vacuum conveyor belt.

5. The carton feed opening wheel assembly of claim 4, wherein said support frame is constructed and arranged for movement along at least a portion of the path of travel with respect to said at least one vacuum conveyor belt.

6. The carton feed opening wheel assembly of claim 1, the wheel frame of said carton opening wheel further comprising three pairs of equally spaced and generally parallel arms extending radially away from said central shaft, a connecting shaft formed along a longitudinal axis for each of said pairs of arms, one each of said connecting shafts extending between each of said pairs of arms and being fastened thereto, each said connecting shaft being parallel to said central shaft, and at least one suction cup supported on each said connecting shaft.

7. The carton feed opening wheel assembly of claim 6, each said connecting shaft having a pair of spaced and generally parallel suction cups supported thereon with respect to said at least one vacuum conveyor belt.

8. The carton feed opening wheel assembly of claim 6, said wheel frame further comprising:

a phasing hub mounted on said central shaft;

a phasing pulley mounted on one of the ends of each said connecting shaft, each said phasing pulley being in substantial alignment with said phasing hub;

a phasing belt separately received on said phasing hub and one each of said phasing pulleys for each said connecting shaft;

wherein said connecting shafts are each rotatably supported on said pairs of arms, said connecting shafts being rotated about their respective longitudinal axes by said phasing belts as said wheel frame is rotated about said central axis.

9. The carton feed opening wheel assembly of claim 8, wherein each of said phasing pulleys is offset with respect to one another.

10. The carton feed opening wheel assembly of claim 8, wherein each of said phasing belts is sized and shaped to rotate each said connecting shaft so that said at least one suction cup on each of said connecting shafts maintains a constant fixed orientation with respect to said at least one vacuum conveyor belt as said wheel frame is rotated about said central shaft.

11. The carton feed opening wheel assembly of claim 1, said drive means for rotating said wheel frame about said central shaft comprising a servomotor, a gear reducer operably connected to said servomotor, said gear reducer also being operably connected to the central shaft of said wheel frame.

12. In a carton feed opening wheel assembly used to open carton blanks into cartons on a packaging machine, the packaging machine having a framework with an infeed end and a spaced discharge end, a carton transport conveyor supported on the framework and extending along a path of travel from the infeed end toward the discharge end of the packaging machine, a carton magazine assembly supported at the infeed end of the packaging machine and having a supply of unopened carton blanks, each unopened carton blank having a bottom portion and a juxtaposed top portion, and a carton opening station supported on the packaging machine framework intermediate the carton magazine assembly and the carton transport conveyor, the carton opening station having at least one endless vacuum conveyor belt moving in the direction of the path of travel and being supplied with unopened carton blanks from the carton magazine assembly, the improvement comprising:

a carton opening wheel positioned at the carton opening station with respect to the at least one vacuum conveyor belt;

said carton opening wheel having a wheel frame constructed about a central longitudinal shaft said wheel frame further comprising:

three pairs of equally spaced and generally parallel arms extending radially away from said central shaft;

a connecting shaft formed along a longitudinal axis for each of said pairs of arms, one each of said connecting shafts extending between each of said pairs of arms and being fastened thereto, each said connecting shaft being parallel to said central shaft;

at least one suction cup supported on each said connecting shaft, each said suction cup being constructed and arranged for engaging the top portions of the respective unopened carton blanks;

a phasing hub mounted on said central shaft;

a phasing pulley mounted on one of the ends of each said connecting shaft, each said phasing pulley being in substantial alignment with said phasing hub;

a phasing belt separately received on said phasing hub and one each of said phasing pulleys for each said connecting shaft;

wherein said connecting shafts are each rotatable supported on said pairs of arms, said connecting shafts being rotated about their respective longitudinal axes by said phasing belts as said wheel frame is rotated about said central axis; and drive means for rotating said wheel frame about said central shaft so that said at least one suction cup engages the top portion of the unopened carton blanks being moved on the vacuum conveyor belts at substantially the same speed and direction as the speed and direction of the unopened carton blanks moving on the vacuum conveyor belts, said drive means being constructed and arranged to thereafter retard the speed of said at least one suction cup with respect to the speed of the pair of vacuum belts moving along the path of travel while simultaneously moving said at least one suction cup in a generally perpendicular direction away from the vacuum conveyor belts for lifting the top portion of the carton blank with respect to the bottom portion of the carton blank to open the carton blank.

13. A packaging machine, the packaging machine being supplied with a plurality of unopened carton blanks, each unopened carton blank having a bottom portion and a juxtaposed top portion, said packaging machine comprising:

a) a framework, said framework having an infeed end and a spaced discharge end;

b) a carton transport conveyor supported on the framework and extending along a path of travel from the infeed end toward the discharge end of the packaging machine;

c) a carton opening station supported on the framework upstream of the carton transport conveyor;

d) a carton magazine assembly supported at the infeed end of the packaging machine for supplying unopened carton blanks to said carton opening station;

e) at least one endless vacuum conveyor belt moving in the direction of the path of travel positioned at said carton opening station and extending from said carton magazine assembly to said carton transport conveyor for receiving unopened carton blanks from said carton magazine assembly thereon;

f) means for applying a vacuum to the bottom portion of the unopened carton blanks received on said at least one vacuum conveyor belt;

g) a carton opening wheel assembly positioned at the carton opening station with respect to said at least one vacuum conveyor belt, said carton opening wheel assembly having a wheel frame constructed about a central longitudinal shaft and having at least one pair of parallel spaced arms extending radially away from said central shaft, said at least one pair of arms supporting at least one suction cup constructed and arranged for engaging the top portion of the unopened carton blank;

h) drive means for rotating said wheel frame about said central shaft; and i) a control processor, said control processor having an electronic cam profile programmed therein, said electronic cam profile being programmed to control the speed of said drive means with respect to the speed of said at least one vacuum conveyor belt;

j) wherein said drive means rotates said wheel frame about said central shaft so that said at least one suction cup engages the top portion of each unopened carton blank being moved on said at least one vacuum conveyor belt at substantially the same speed and direction as the speed and direction of the unopened carton blanks moving on said vacuum conveyor belt, said drive means being constructed and arranged to then retard the speed of said at least one suction cup with respect to the speed of said at least one vacuum conveyor belt in the direction of the path of travel while also simultaneously moving said at least one suction cup in a generally perpendicular direction away from said at least one vacuum conveyor belt for lifting the top portion of the carton blank with respect to the bottom portion of the carton blank to open the carton.

14. A method of opening carton blanks into cartons on a packaging machine, the packaging machine having a carton magazine assembly, the carton magazine assembly having a supply of unopened carton blanks, each unopened carton blank having a bottom portion and a juxtaposed top portion, and a carton opening station positioned adjacent the carton magazine assembly, the carton opening station having an endless vacuum conveyor belt moving along a path of travel away from the carton magazine assembly, the vacuum conveyor belt being supplied with unopened carton blanks from the carton magazine assembly and applying a vacuum force to the bottom portion of the carton blanks received thereon for holding the bottom portion of the carton blank on the vacuum conveyor belt as it is moved along the path of travel, said method comprising the steps of:

a) positioning a carton opening wheel assembly at the carton opening station with respect to the vacuum conveyor belt;

b) providing a control processor having an electronic cam profile programmed therein and controlling the speed of said carton opening wheel assembly in accordance with said electronic cam profile;

c) moving at least one suction cup supported on said carton opening wheel assembly in the direction of the path of travel and into engagement with the top portion of the unopened carton blank at substantially the same speed and direction as the speed and direction of the carton blank on the vacuum conveyor belt;

d) retarding the speed of said at least one suction cup in the direction of the path of travel with respect to the speed of the vacuum conveyor belt while moving said at least one suction cup in a generally perpendicular direction away from the carton blank held on the vacuum conveyor belt; and e) lifting the top portion of the carton blank with respect to the bottom portion of the carton blank in response thereto with said at least one suction cup for opening the carton blank.

15. A method of opening carton blanks into cartons on a packaging machine, the packaging machine having a framework with an infeed end and a spaced discharge end, a carton transport conveyor for carrying opened cartons supported on the framework and extending along a path of travel from the infeed end toward the discharge end of the packaging machine, a carton magazine assembly supported at the infeed end of the packaging machine and having a supply of unopened carton blanks, each unopened carton blank having a bottom portion and a juxtaposed top portion, and a carton opening station supported on the framework between the carton magazine assembly and the carton transport conveyor, the carton opening station having an endless vacuum conveyor belt extending along a path of travel toward the carton transport conveyor, said method comprising the steps of:

a) receiving one of the unopened carton blanks from the carton magazine assembly on the vacuum conveyor belt positioned at the carton opening station;

b) applying a vacuum force to the bottom portion of the carton blank with said vacuum conveyor belt and holding the bottom portion of the unopened carton blank on the vacuum conveyor belt in response thereto;

c) moving the vacuum conveyor belt and the unopened carton blank held thereon in the direction of the path of travel toward the carton transport conveyor;

d) positioning a carton opening wheel assembly at the carton opening station with respect to the vacuum conveyor belt;

e) providing a control processor having an electronic cam profile programmed therein for controlling the speed of said carton opening wheel assembly, and controlling the speed of said carton opening wheel assembly with respect to the speed of the vacuum conveyor belt in response thereto;

f) moving at least one suction cup supported on said carton opening wheel assembly in the direction of the path of travel and into engagement with the top portion of the unopened carton blank at substantially the same speed and direction as the speed and direction of the unopened carton blank along the path of travel;

g) retarding the speed of said at least one suction cup in the direction of the path of travel with respect to the speed of the vacuum conveyor belt while moving said at least one suction cup in a generally perpendicular direction away from the bottom portion of the carton blank; and h) lifting the top portion of the carton blank with respect to the bottom portion of the carton blank in response thereto with said at least one suction cup to open the carton blank.

* * * * *